US007604232B2

(12) United States Patent
Nakashima et al.

(10) Patent No.: US 7,604,232 B2
(45) Date of Patent: Oct. 20, 2009

(54) SHEET FEEDING DEVICE

(75) Inventors: Akira Nakashima, Kyoto (JP); Toyoaki Nanba, Higashiosaka (JP)

(73) Assignee: Sharp Kabushiki Kaisha, Osaka-shi, Osaka (JP)

( * ) Notice: Subject to any disclaimer, the term of this patent is extended or adjusted under 35 U.S.C. 154(b) by 366 days.

(21) Appl. No.: 11/513,212

(22) Filed: Aug. 31, 2006

(65) Prior Publication Data

US 2007/0045946 A1 Mar. 1, 2007

(30) Foreign Application Priority Data

Sep. 1, 2005 (JP) ..... 2005-252988

(51) Int. Cl.
*B65H 1/22* (2006.01)

(52) U.S. Cl. ..... 271/164; 312/222; 312/332.1

(58) Field of Classification Search ..... 271/162, 271/163, 164; 399/110, 391, 393; 312/333, 312/332.1, 222
See application file for complete search history.

(56) References Cited

U.S. PATENT DOCUMENTS 4,000,800 A * 1/1977 Loucks, Sr. ..... 194/215
5,157,448 A * 10/1992 Lang ..... 399/23
5,918,875 A * 7/1999 Masley et al. ..... 271/162
7,188,835 B2 * 3/2007 Lee et al. ..... 271/147

FOREIGN PATENT DOCUMENTS

JP S60-191928 A 9/1985
JP 08-004383 A 1/1996
JP H09-086681 A 3/1997

* cited by examiner

*Primary Examiner*—Patrick H Mackey
*Assistant Examiner*—Michael C McCullough
(74) *Attorney, Agent, or Firm*—Birch, Stewart, Kolasch & Birch, LLP

(57) ABSTRACT

A sheet feeding device includes a casing having an engagement portion, and a sheet stacker detachably housed in the casing. The stacker has a liftable stacking plate, a handle, a lock claw, and a transmission mechanism. The plate is provided for loading a plurality of sheets. The handle is pivotable between operational and nonoperational positions. The claw is pivotable between engaged and disengaged positions. In the engaged and disengaged positions, the claw is engaged with, and disengaged from, the engagement portion, respectively. The mechanism has a solenoid and an interlock member. The solenoid has a plunger movable between locking and unlocking positions according to an input driving signal. The member allows, only with the plunger in the unlocking position, the claw to be moved from the engaged position to the disengaged position in association with pivot movement of the handle from the nonoperational position to the operational position.

4 Claims, 8 Drawing Sheets

SHEET FEEDING DEVICE

CROSS REFERENCE

This Nonprovisional application claims priority under 35 U.S.C. §119(a) on Patent Application No. 2005-252988 filed in Japan on Sep. 1, 2005, the entire contents of which are hereby incorporated by reference.

BACKGROUND OF THE INVENTION

The present invention relates to a sheet feeding device, such as a large capacity cassette (hereinafter merely referred to as LCC), for storing a large number of sheets to be fed into a sheet processing apparatus such as an image forming apparatus.

Conventional LCCs are designed for installation beside a sheet processing apparatus and for storing sheets of size that are most frequently used. JP H09-086681A discloses an image forming apparatus provided with an LCC that has a capacity of approximately 2,000 sheets of A4-size plain paper. Sheets loaded in the LCC have long sides oriented perpendicular to a direction in which sheets are fed (hereinafter merely as the sheet feeding direction).

The LCC has a casing, and a sheet stacker mounted within the casing. The stacker is provided with a stacking plate for stacking sheets. The stacking plate is liftable within a predetermined range. Sheets stacked on the plate are sequentially fed into the apparatus, one by one from top to bottom. As stacked sheets are fed and decrease in number, the plate is raised. When sheets are to be replenished, the plate is lowered.

The stacker is detachably housed in the casing. The stacker is moved frontward out of the casing when sheets are to be replenished or currently loaded paper are to be changed to a different size or type of paper.

If the stacker moves out of the casing under its own weight, in the meanwhile, the stacker may collide with, and cause an injury to, an operator. Accordingly, the stacker needs to be tightly held in place within the casing. For this purpose, a first lock mechanism is provided that prevents movement of the stacker in the casing until a handle mounted at the front of the stacker is operated.

Also, a sheet jam or damage to the apparatus is caused by detaching the stacker from the casing for a duration of time that a sheet is being fed from the LCC to the apparatus, i.e., a sheet feeding operation is being performed. A sheet feeding operation needs to be completely stopped before the stacker is detached from the casing. Thus, a second lock mechanism is required that prevents the stacker from being moved out of the casing, even if the handle is operated, for a duration of time that a sheet feeding operation is being performed.

The two lock mechanisms, however, have the following problems. The two mechanisms take up respective spaces in the stacker and the casing, thereby causing upsizing of the LCC.

Also, when the handle is operated while a sheet feeding operation is being performed, a first lock mechanism, which is linked to the operation of the handle, is released, while a second lock mechanism, which maintains the stacker in the housed position for a duration of time that a sheet feeding operation is being performed, is kept engaged. If an operator tries to pull the stacker out of the casing with the first lock mechanism released and the second lock mechanism engaged, the operator exerts a pulling force on the second lock mechanism. Repeatedly exerted pulling force causes a failure in, or damage to, the second lock mechanism.

In light of the foregoing, a feature of the invention is to provide a sheet feeding device having a single lock mechanism that prevents a sheet stacker from moving out of a casing under its own weight or from being moved out of the casing for a duration of time that a sheet feeding operation is being performed, without causing upsizing of the device and a failure in, or damage to, the lock mechanism.

SUMMARY OF THE INVENTION

A sheet feeding device includes a casing having an engagement portion, and a sheet stacker detachably housed in the casing. The stacker has a liftable stacking plate, a handle, a lock claw, and a transmission mechanism. The plate is provided for loading a plurality of sheets. The handle is supported pivotably between operational and nonoperational positions. The claw is supported pivotably between engaged and disengaged positions. In the engaged and disengaged positions, the claw is engaged with, and disengaged from, the engagement portion, respectively. The mechanism has a solenoid and an interlock member. The solenoid has a plunger movable between locking and unlocking positions according to an input driving signal. The member allows, only when the plunger is in the unlocking position, the claw to be moved from the engaged position to the disengaged position in association with pivot movement of the handle from the nonoperational position to the operational position.

DETAILED DESCRIPTION OF THE INVENTION

Figure 1:
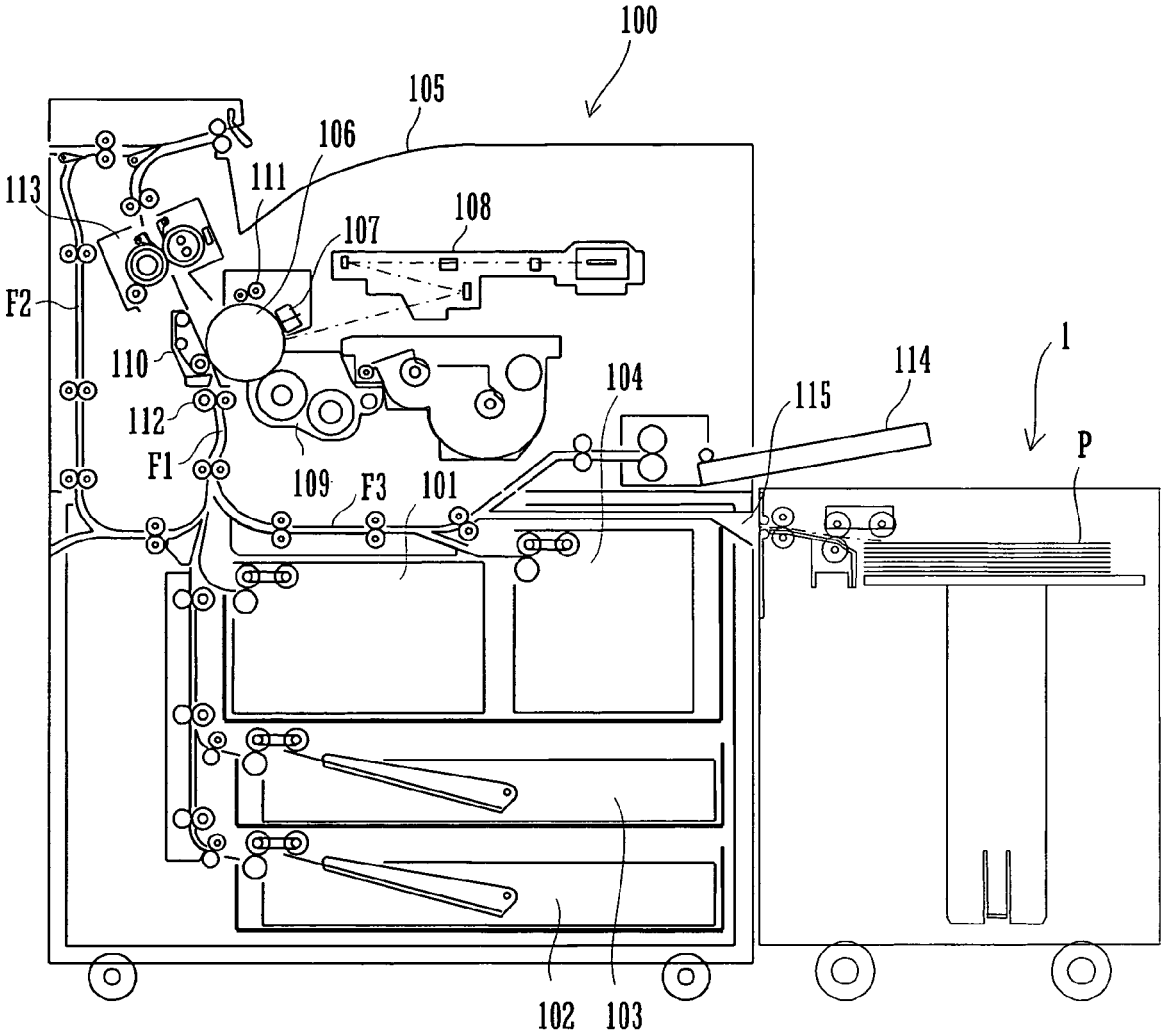
FIG. 1 is a schematic cross-sectional view of an image forming apparatus as a sheet processing apparatus to which a sheet is fed from an LCC according to embodiments of the invention.

Referring to the accompanying drawings, preferred embodiments of the invention are described below. Referring to FIG. 1, a sheet feeding device according to a first embodiment of the invention, such as an LCC 1, is installed beside a sheet processing apparatus such as an image forming apparatus 100. Instead of the single LCC 1 as in the first embodiment, a plurality of LCCs may be arranged in alignment with one another. The LCC 1 feeds a sheet of paper P, or another material such as OHP film, into the apparatus 100.

The apparatus 100 forms an image on a sheet by performing an electrophotographic image forming process. The apparatus 100 has sheet cassettes 101 to 104 and a sheet output tray 105 in a bottom portion and a top portion thereof, respectively. A sheet transport path F1 is provided so as to lead from the cassettes 101 to 103 to the tray 105. A photoreceptor drum 106 is positioned along the path F1. Around the drum 106 arranged are a charging device 107, an optical scanning unit 108, a developing unit 109, a transferring unit 110, a cleaning unit 111, and the like.

Registration rollers 112 are provided upstream of the drum 106 in a direction in which a sheet is transported along the path F1 (hereinafter referred to merely as the sheet transport direction). The rollers 112 feed a sheet P to a transfer area between the drum 106 and the unit 110 in synchronization with rotation of the drum 106. A fusing unit 113 is provided downstream of the drum 106 in the sheet transport direction.

The device 107 applies a predetermined level of electrostatic charge to a circumferential surface of the drum 106. The unit 108 forms an electrostatic latent image on the circumferential surface of the drum 106 according to external input image data. The unit 109 supplies toner to the circumferential surface and develops the electrostatic latent image into a toner image. The unit 110 transfers the toner image from the circumferential surface to a sheet. The unit 113 fuses and fixes the toner image onto the sheet. The sheet with the toner image fixed thereto is output to the tray 105. The unit 111 removes and collects residual toner that remains on the circumferential surface after the transfer operation is completed.

The apparatus 100 is also provided with a switchback transport path F2 and a sheet transport path F3. In a duplex image forming process in which an image is formed on each side of a sheet, the path F2 is used to reverse a first and a second sides of the sheet with an image formed on the first side and then transport the sheet to the transfer area. The path F3 is used to feed a sheet from either one of the cassette 104, a manual feeding tray 114, and a sheet receiving section 115, to the transfer area. The path F3 extends approximately horizontally so as to join, at one end, the path F1 at an upstream point of the rollers 112 and to be divided, at the other end, to lead to each of the cassette 104, the tray 114, and the section 115. The tray 114 is provided on a side surface of the apparatus 100 for feeding sheets of various sizes. The section 115 is provided for receiving sheets fed from the LCC 1.

Figure 2:
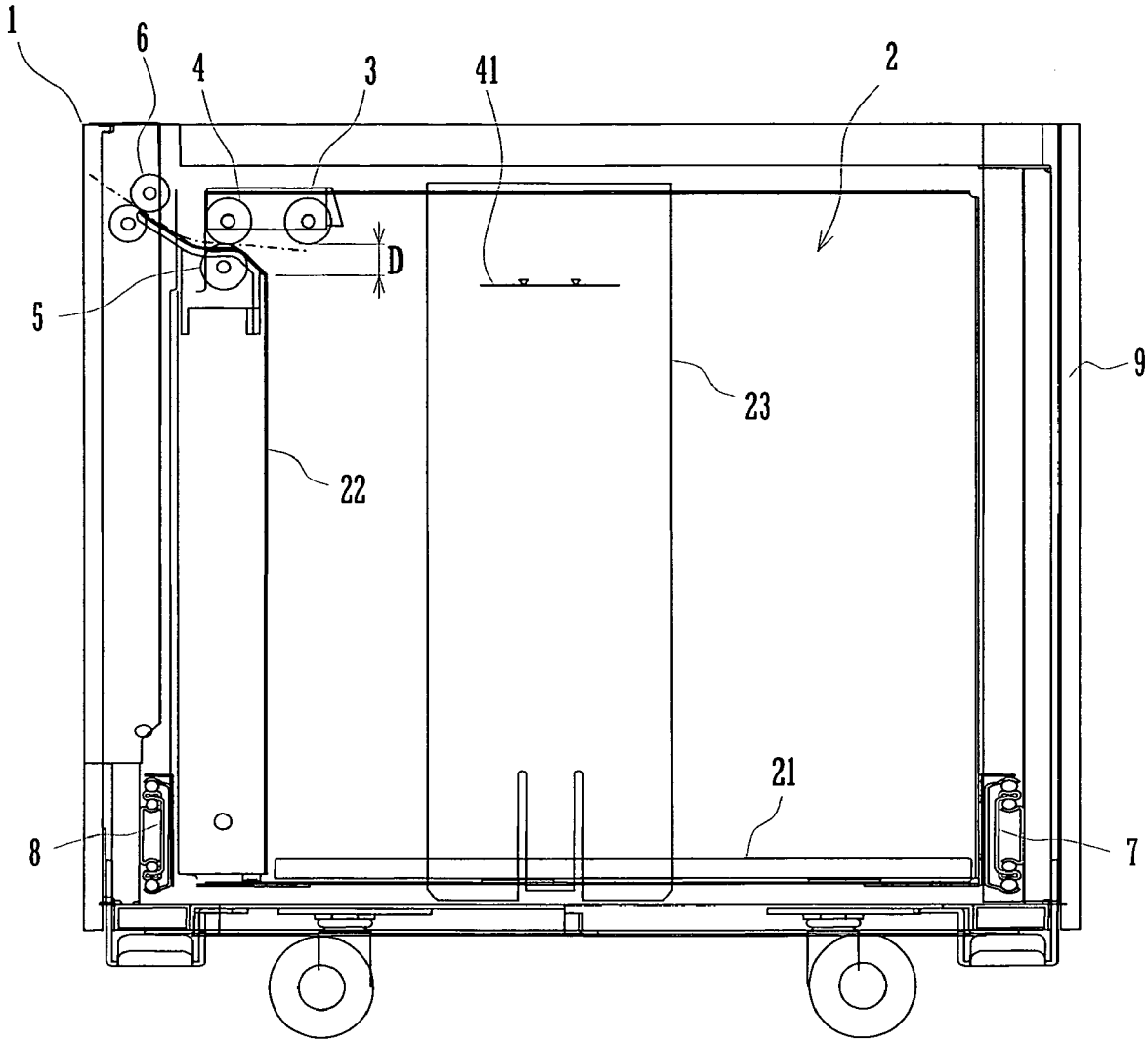
FIG. 2 is a schematic front cross-sectional view of an LCC according to a first embodiment of the invention.

Referring to FIG. 2, the LCC 1 includes a casing 9, a sheet stacker 2, a pick-up roller 3, a feeding roller 4, a reversing roller 5, and transporting rollers 6. The stacker 2 has a stacking plate 21, a front guiding plate 22, side guiding plates 23 and 24, and a rear guiding plate. The plate 24 and the rear guiding plate are not shown in the figure. While being held in a horizontal position, the plate 21 is vertically movable within a predetermined range inside the stacker 2. A plurality of sheets are neatly stacked on the plate 21 by being positioned with the front guiding plate 22, the side guiding plates 23 and 24, and the rear guiding plate.

The roller 3 is supported such that the roller 3 is pivoted about a rotary shaft for the feeding roller 4, within a predetermined range D between an upper position and a lower position. Within the range D, the roller 3 is pivoted, brought into contact with a top one of sheets stacked on the plate 21, and rotated to guide the top sheet between the feeding roller 4 and the reversing roller 5.

The rollers 4 and 5 are both rotated clockwise in FIG. 2 to allow passage of the sheet therebetween. In a case where multiple sheets are picked up at a time and led between the rollers 4 and 5 by the roller 3, only a top sheet is brought into contact with the roller 4 and led to the transporting rollers 6. The rest of the sheets are returned to the plate 21 by the roller 5.

As the sheet feeding operation is repeated and the number of sheets loaded on the plate 21 decreases, level of an upper surface of a top one of the sheets is gradually lowered. When the level falls below a lower limit level of the range D, the pick-up roller 3 is prevented from having contact with an upper surface of a top sheet, and thus from feeding the sheet. Therefore, the plate 21 is raised by a predetermined amount by a lifting mechanism (not shown) when it is detected that level of an upper surface of a top sheet approaches the lower limit level of the range D. As the feeding operation is repeated and the number of sheets loaded on the plate 21 decreases, the plate 21 is repeatedly raised.

The LCC 1 has a capacity of a large number of sheets (approximately 5,000 sheets in the present embodiment) of various sizes such as of A3, B4, A4, and B5.

Thus, the plates 23 and 24 are rendered movable on the plate 21 within a predetermined range along a direction perpendicular to the sheet feeding direction. Movement of one of the plates 23 and 24 in a direction is transmitted to the other, so that the other is moved in the opposite direction. Accordingly, sheets stacked on the plate 21 are positioned approximately at the center of the plate 21 along the direction.

FIGS. 3A to 3D are diagrams illustrating positions of the stacking plate 21. The sheet stacker 2 is provided with sensors 31 and 32, and the plate 21 is provided with a sensor 33. The sensor 31 serves to detect paper P loaded on the plate 21, or the plate 21 itself if the plate 21 is not loaded with paper P, at a reference level that is set below the lower limit level of the range D. The sensor 32 serves to detect the plate 21 at lowest level within the movable range of the plate 21. The sensor 33 serves to detect whether the plate 21 is loaded with paper P.

Figure 3A:
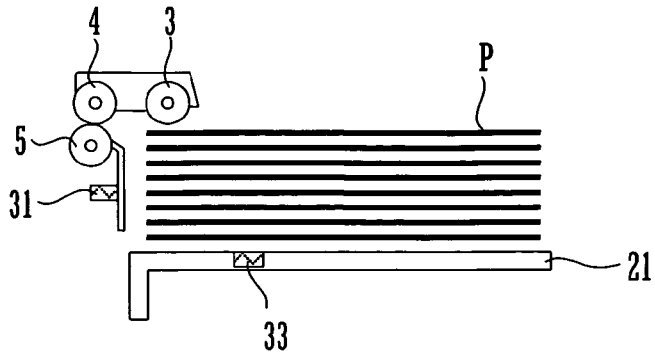
FIGS. 3A to 3D are diagrams illustrating different positions of a stacking plate mounted in the LCC.
Figure 3B:
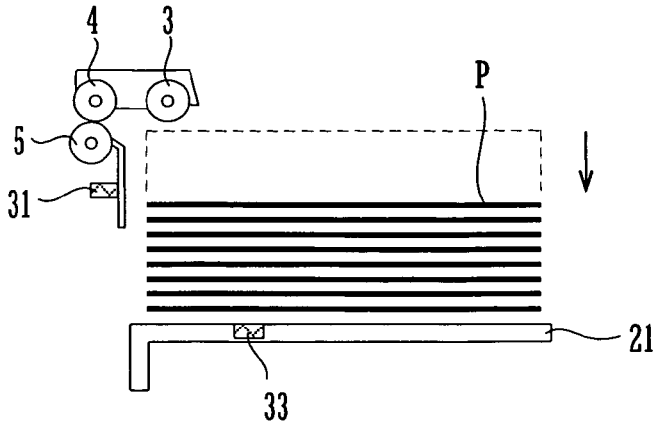
Figure 3C:
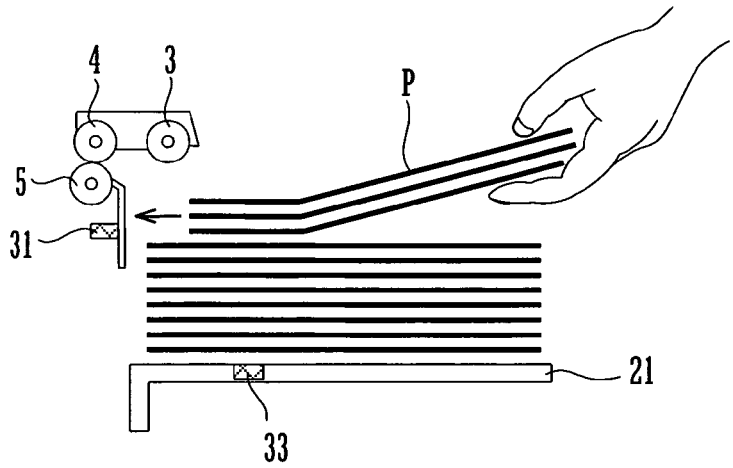
Figure 3D:
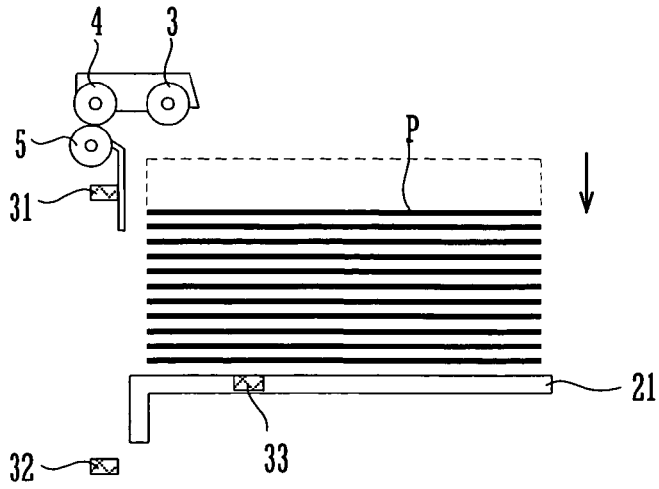

As the sheet feeding operation is repeated and the number of sheets of paper P loaded on the plate 21 decreases, the plate 21 needs replenishing. In such case, the plate 21 is lowered to such a level that the loaded paper P is out of a detection range of the sensor 31, as shown in FIG. 3B. Referring to FIG. 3C, the plate 21 is replenished with paper until the sensor 31 detects the loaded paper P. Then, the plate 21 is lowered to such a level that the loaded paper P is out of the detection range of the sensor 31, as shown in FIG. 3D.

When the sensor 33 detects that the plate 21 is not loaded with paper P, meanwhile, the plate 21 is lowered to such a level that the plate 21 itself is out of the detection range of the sensor 31. When the plate 21 is replenished with paper, then, the plate 21 is lowered to such a level that the loaded paper P is out of the detection range of the sensor 31.

The lowering of the plate 21 can be repeated until the sensor 32 detects the plate 21.

Figure 4A:
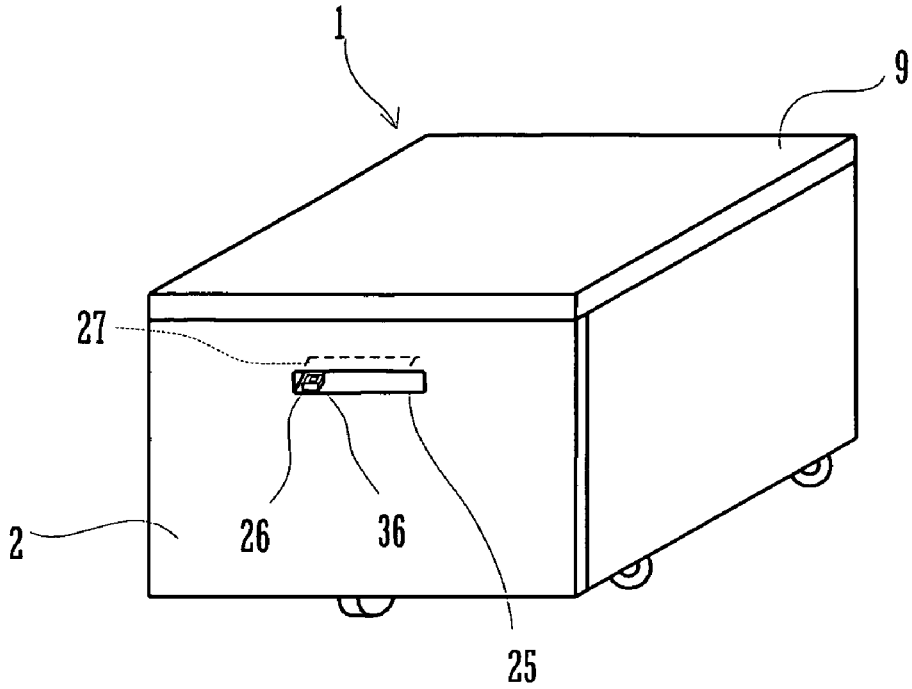
FIGS. 4A to 4B are perspective views illustrating a schematic configuration of the LCC.
Figure 4B:
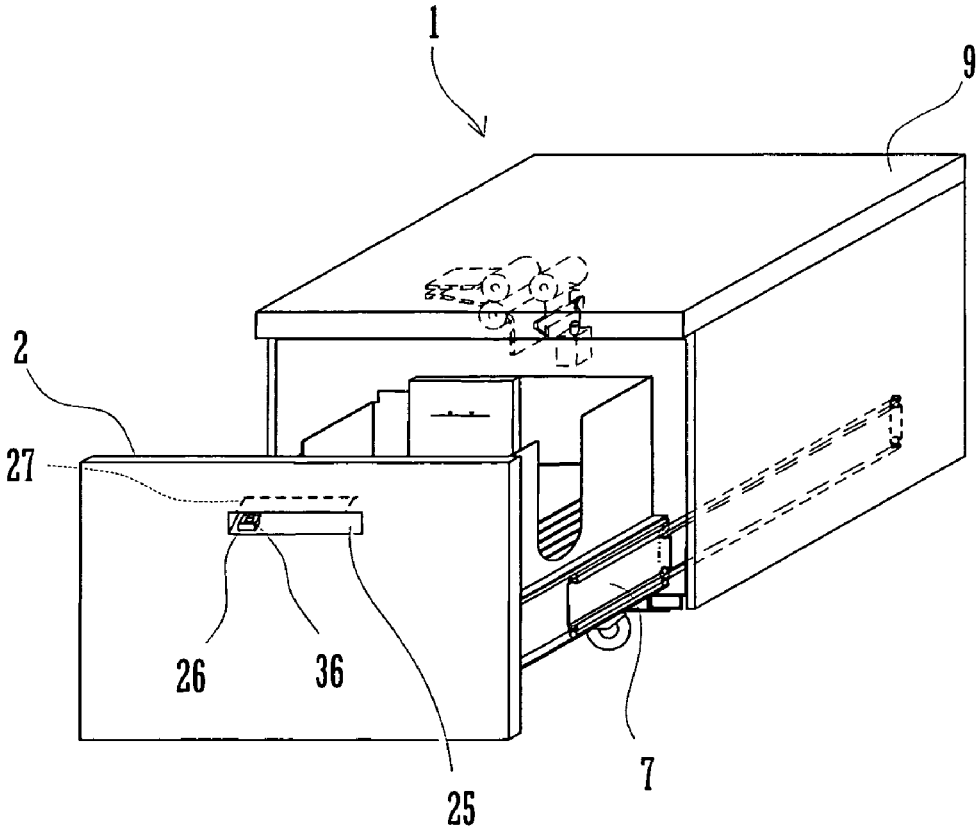

FIGS. 4A and 4B are perspective views illustrating a schematic configuration of the LCC 1. Inside the LCC 1, there are provided slide rail assemblies 7 and 8 (the assembly 8 is not shown). The assemblies 7 and 8 are mounted so as to connect right and left inner walls of the casing 9 with right and left outer walls of the stacker 2, respectively (see also FIG. 2). The assemblies 7 and 8 allow the stacker 2 to be detachably housed in the casing 9. The stacker 2 is movable horizontally between a housed position as shown in FIG. 4A and an exposed position as shown in FIG. 4B. In the housed position, the stacker 2 is housed in the casing 9. The stacker 2 is moved frontward from the housed position to the exposed position where the entire plate 21 is exposed at the front of the casing 9.

The stacker 2 has a handle portion 25 on the front. The handle portion 25 has an operating button 26 mounted in such a position as to be readily seen from the outside. A handle 27 is provided in an upper part of the portion 25. The handle 27 is pivotable between a nonoperational position and an operational position. The handle 27 is pivoted to the operational position by raising a front flap thereof. The button 26 has a lamp 36 embedded therein.

The stacker 2 has a lock device to be described below. The lock device selectively allows and prevents movement of the stacker 2 from the housed position to the exposed position. In a condition where movement of the stacker 2 is allowable, the lock device is released by pivoting the handle 27 from the nonoperational position to the operational position. Thus, the stacker 2 is allowed to be moved from the housed position to the exposed position.

Figure 5:
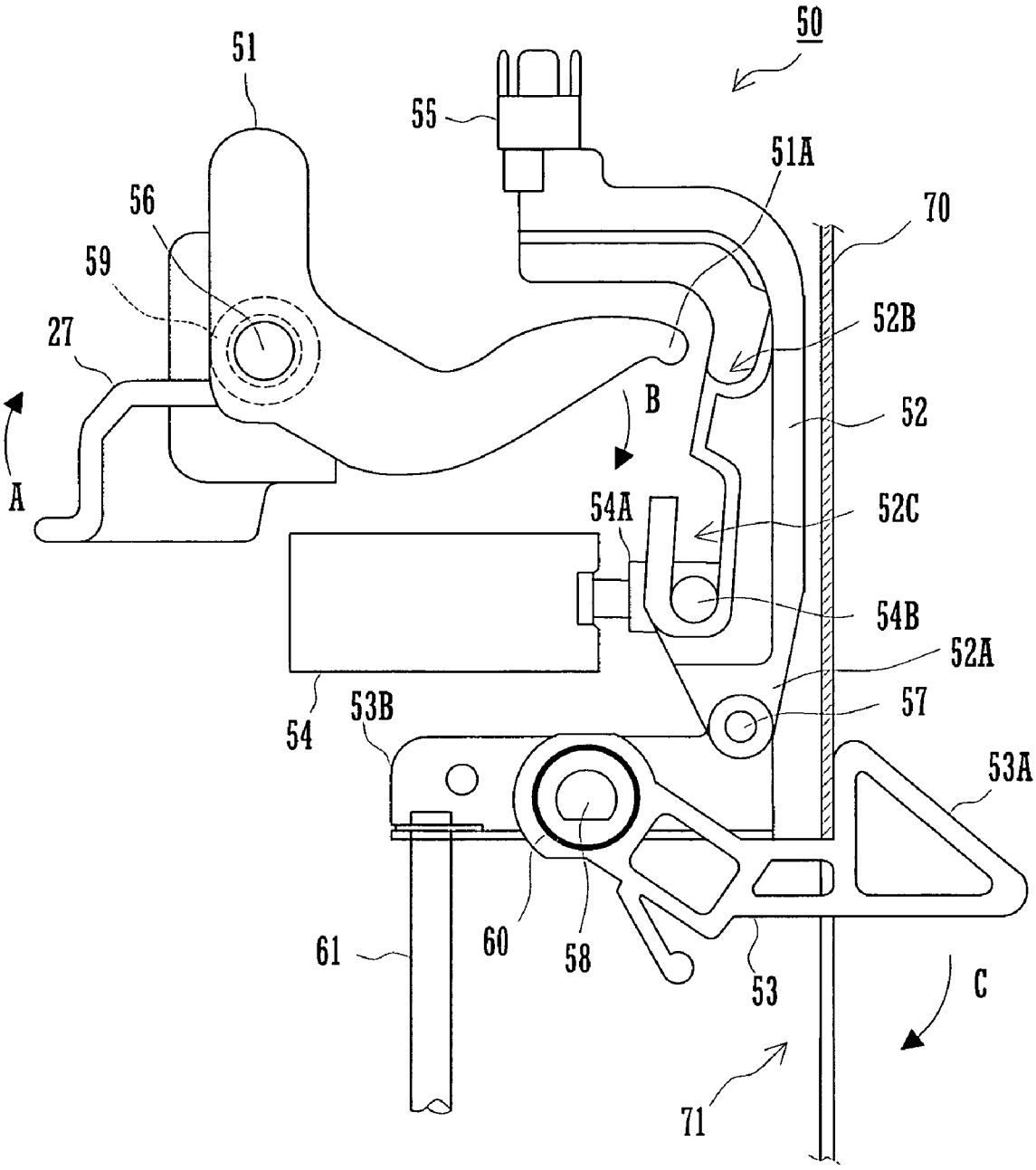
FIG. 5 is a schematic side view illustrating a configuration of a lock device provided in the LCC.

FIG. 5 is a schematic side view illustrating a configuration of a lock device 50 provided in the LCC 1. The device 50 includes a first arm 51, a second arm 52, a lock claw 53, a solenoid 54, a locking position sensor 55, and return springs 59 and 60. The arm 51 is linked with the handle 27. The arm 52 is linked with the claw 53.

The arm 51 is supported at a middle portion on a handle shaft 56 in such a manner that the arm 51 is pivoted about the shaft 56 in association with the handle 27. When the handle 27 is pivoted in a direction of arrow A from the nonoperational position to the operational position, thus, a contact end 51A of the arm 51 is moved in a downward direction of arrow B.

The arm 52 is supported at a lower end 52A on a metal support 53B so as to be pivoted about a pivot 57. The arm 52 has a depression 52B and an engagement portion 52C. The depression 52B faces upward. The end 51A is moved in the direction of arrow B to be selectively fitted into the depression 52B. The solenoid 54A has a plunger 54A with a pin 54B formed on a leading end. The pin 54B is engaged in the portion 52C.

The claw 53 has an engagement portion 53A of wedge shape at a rear end. The claw 53 is supported so as to be pivoted, together with the support 53B, about a pivot shaft 58 between an engaged position and a disengaged position. The shaft 58 is located more to the front of the casing 9 than the pivot 57. With the claw 53 in the engaged position, the portion 53A is in contact with a rear surface of a frame 70 of the casing 9. With the claw 53 in the disengaged position, meanwhile, the portion 53A is out of contact with the rear surface. When the claw 53 is in the disengaged position, thus, the portion 53A is allowed to pass through the hole 71. The frame 70 corresponds to the engagement portion of the Claims.

The plunger 54A is movable between a locking position and an unlocking position. In the locking position, the plunger 54A protrudes from the solenoid 54 toward the rear of the casing 9. In the unlocking position, the plunger 54A is withdrawn in the solenoid 54. Upon receipt of a first driving signal, the solenoid 54 moves the plunger 54A from the locking position to the unlocking position. Upon receipt of a second driving signal, the solenoid 54 moves the plunger 54A from the unlocking position to the locking position. Upon receipt of neither the first nor the second driving signal, the solenoid 54A holds the plunger 54A in a current one of the locking and unlocking positions.

It is not necessary to continue to send the first or second driving signal to the solenoid 54 in order to hold the plunger 54A in the unlocking or locking position, with a result of reduced power consumption.

The locking position sensor 55 detects an upper end of the arm 52 at a predetermined position, to determine whether the arm 52 is in a working position or a non-working position.

The return spring 59 corresponds to the first return member of the Claims. In the present embodiment, a torsion coil spring wound around the shaft 56 is used as the spring 59. The spring 59 urges the handle 27 toward the nonoperational position.

The return spring 60 corresponds to the second return member of the Claims. In the present embodiment, a torsion coil spring wound around the shaft 58 is used as the spring 60. The spring 60 urges the claw 53 toward the engaged position.

The arms 51 and 52 and the springs 59 and 60 correctively correspond to the interlock member of the Claims.

FIGS. 6A to 6D are views illustrating operation of the lock device 50. In the locking position, referring to FIG. 6A, the plunger 54A presses the engagement portion 52C toward the rear of the casing 9 through the pin 54B. Thus, the arm 52 is located in the non-working position, with the contact end 51A away from the depression 52B. In this state, the end 51A is prevented from being fitted into the depression 52B even when the handle 27 is operated and the arm 51 is moved to a position indicated by a chain double-dotted line. Accordingly, the arm 52 is not moved, so that the claw 53 remains in the engagement position. At the time, the sensor 55 detects the upper end of the arm 52 in the non-working position.

Figure 6A:
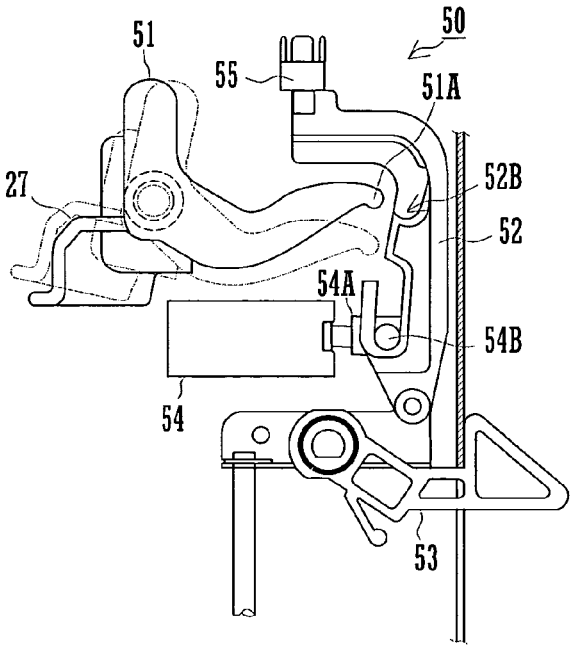
FIGS. 6A to 6D are views illustrating operation of the lock device.
Figure 6B:
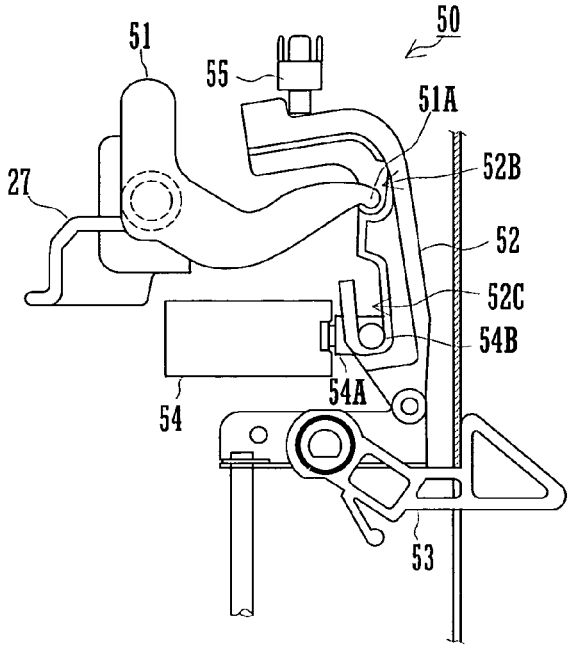

When the first driving signal is input to the solenoid 54, referring to FIG. 6B, the plunger 54A is moved to the unlocking position. Even after the input of the first driving signal is terminated, the plunger 54A is held in the unlocking position until the second driving signal is input.

Figure 6C:
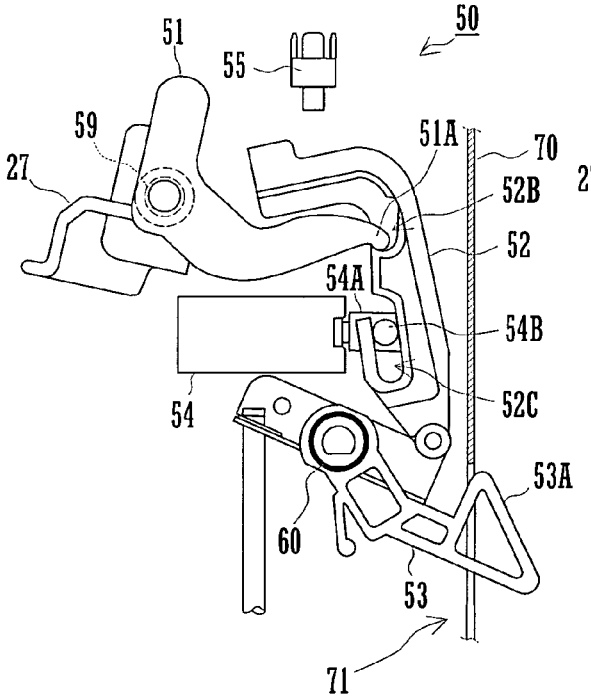

In the unlocking position, the plunger 54A pulls the portion 52C toward the front of the casing 9 through the pin 54B. Thus, the arm 52 is moved to the working position, so that the end 51A enters the depression 52B. Referring to FIG. 6C, the handle 27 is operated in this state, so that the end 51A is moved downward and fitted into the depression 52B. Thus, the arm 52 is pushed down together with the claw 53. The claw 53 is thus pivoted to the disengaged position, thereby allowing passage of the engagement portion 53A through a hole 71. This enables the stacker 2 to be moved from the housed position to the exposed position. At the time, the upper end of the arm 2 is out of the detection range of the sensor 55.

When the force to operate the handle 27 is lost with the plunger 54A in the unlocking position, the handle 27 and the arm 51 are returned to the respective positions as shown in FIG. 6B by the return spring 59. Thus, the downward pressure on the arm 52 is removed, and the arm 52 and the claw 53 are returned to the respective positions as shown in FIG. 6B by the return spring 60.

As the stacker 2 is moved from the exposed position into the housed position with the handle 27, the arms 51 and 52, and the claw 53 in the respective positions as shown in FIG. 6B, a slant surface of the portion 53A is brought into contact with an upper edge of the hole 71, so that the lock claw 53 is pivoted downward. This allows the portion 53A to pass through the hole 71 from frontward to the rearward. Then, the spring 60 returns the claw 53 to the engaged position.

Figure 6D:
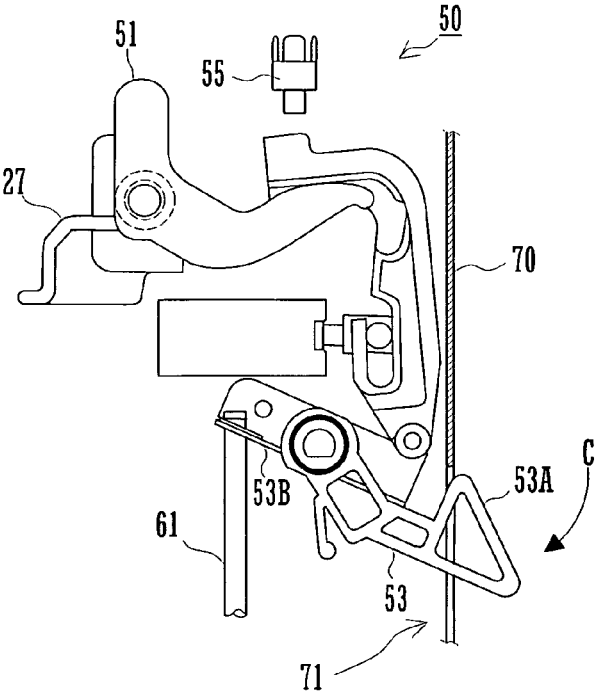

An operating bar 61 is attached at an upper end to the claw 53. The bar 61 extends through a bottom surface of the stacker 2, with a lower end facing a hole provided in a bottom surface of the casing 9 (hereinafter referred to as the bottom hole). Referring to FIG. 6D, the bar 61 is raised upward with a rod-like tool inserted in the bottom hole in order to pivot the claw 53 in a direction of arrow C through the support 53B. This allows the portion 53A to be disengaged from the rear surface of the frame 70. Thus, the bar 61 enables the stacker 2 to be moved out of the casing 9 even in the event of failure in the LCC 1.

Out of the four combinations of positions of the plunger 54A and the handle 27, only the combination of the plunger 54 in the unlocking position and the handle 27 in the operational position allows the claw 53 to be located in the disengaged position.

As described above, operational movement of the handle 27 is selectively transmitted to the claw 53 by controlling input of the first and second driving signals to the solenoid 54. Unless the handle 27 is operated and the first driving signal is input to the solenoid 54, operational movement of the handle 27 is not transmitted to the claw 53, so that the claw 53 is held in the engaged position.

This configuration enables the single lock device 50 that prevents the stacker 2 from moving out of the casing under its own weight and from being moved for a duration of time that a sheet feeding operation is being performed. The single lock device 50 takes up a smaller space, compared to that taken by separate lock mechanisms provided in the stacker 2 and the casing 9, thereby preventing upsizing of the LCC 1. Also, the single lock mechanism prevents the stacker 2 from being moved out of the casing 9, even if the handle 27 is operated, for a duration of time that a sheet feeding operation is being performed, thereby preventing a failure of, and damage to, the lock device 50 itself.

As described earlier, the interlock member of the Claims includes the arms 51 and 52 and the springs 59 and 60. This configuration allows the single claw 53 to be selectively moved to the disengaged position through the combination of the handle 27 in the operational position and the plunger 54A in the unlocking position.

Figure 7:
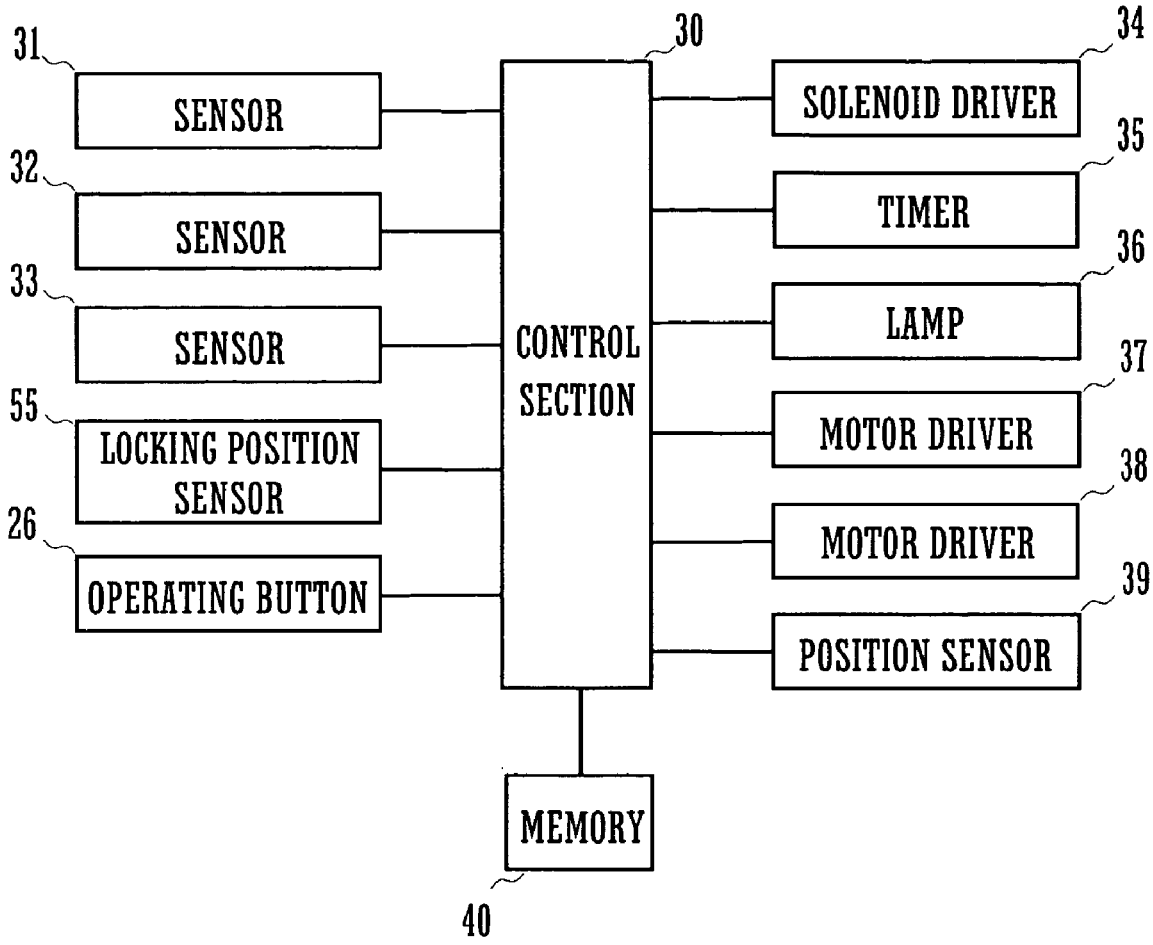
FIG. 7 is a block diagram illustrating a configuration of a control section provided in the LCC.

FIG. 7 is a block diagram illustrating a configuration of a control section 30 provided in the LCC 1. The LCC 1 has a control section 30. To the section 30 connected are input/output devices such as the sensors 31 to 33, the operating button 26, a solenoid driver 34, the lamp 36, motor drivers 37 and 38, the locking position sensor 55, and a position sensor 39. The section 30 has overall control of the input/output devices according to programs stored in a memory 40.

As described earlier, the sensor 31 detects the stacking plate 21, or paper loaded on the plate 21, at the reference level from the side. More specifically, the sensor 31 detects whether an upper surface of the plate 21, or an upper surface of a top sheet of loaded paper, reaches the reference level, and outputs a signal according to the detection result. A lower end of the sensor 31 is located slightly below a level that is lower by the thickness of 500 sheets than a feeding level (i.e., a level at which a top sheet of paper loaded on the plate 21 is positioned to be fed).

The sensor 32 detects whether the plate 21 reaches the lowest level within the movable range of the plate 21, and outputs a signal according to the detection result. The sensor 32 is a reflective sensor positioned so as to face the plate 21 through a slit provided in the front guiding plate 22.

The sensor 33 detects presence or absence of paper P on the plate 21, and outputs a signal according to the detection result.

When the plate 21 is to be replenished with paper, the button 26 is used to release the lock device 50 in order to render the stacker 2 movable.

The driver 34 outputs the first or second driving signal to the solenoid 54 to move the plunger 54A to the unlocking or locking position.

The driver 37 drives a transporting motor (not shown) for rotating the pick-up roller 3, the sheet feeding roller 4, the reversing roller 5, and the transporting rollers 6. The driver 38 drives a lifting motor (not shown) for elevating the plate 21.

The sensor 39 detects whether the stacker 2 is in the housed position, and outputs a signal according to the detection result.

The sensor 55 detects whether the arm 52 is in the working position or in the non-working position, and outputs a signal according to the detection result.

Figure 8:
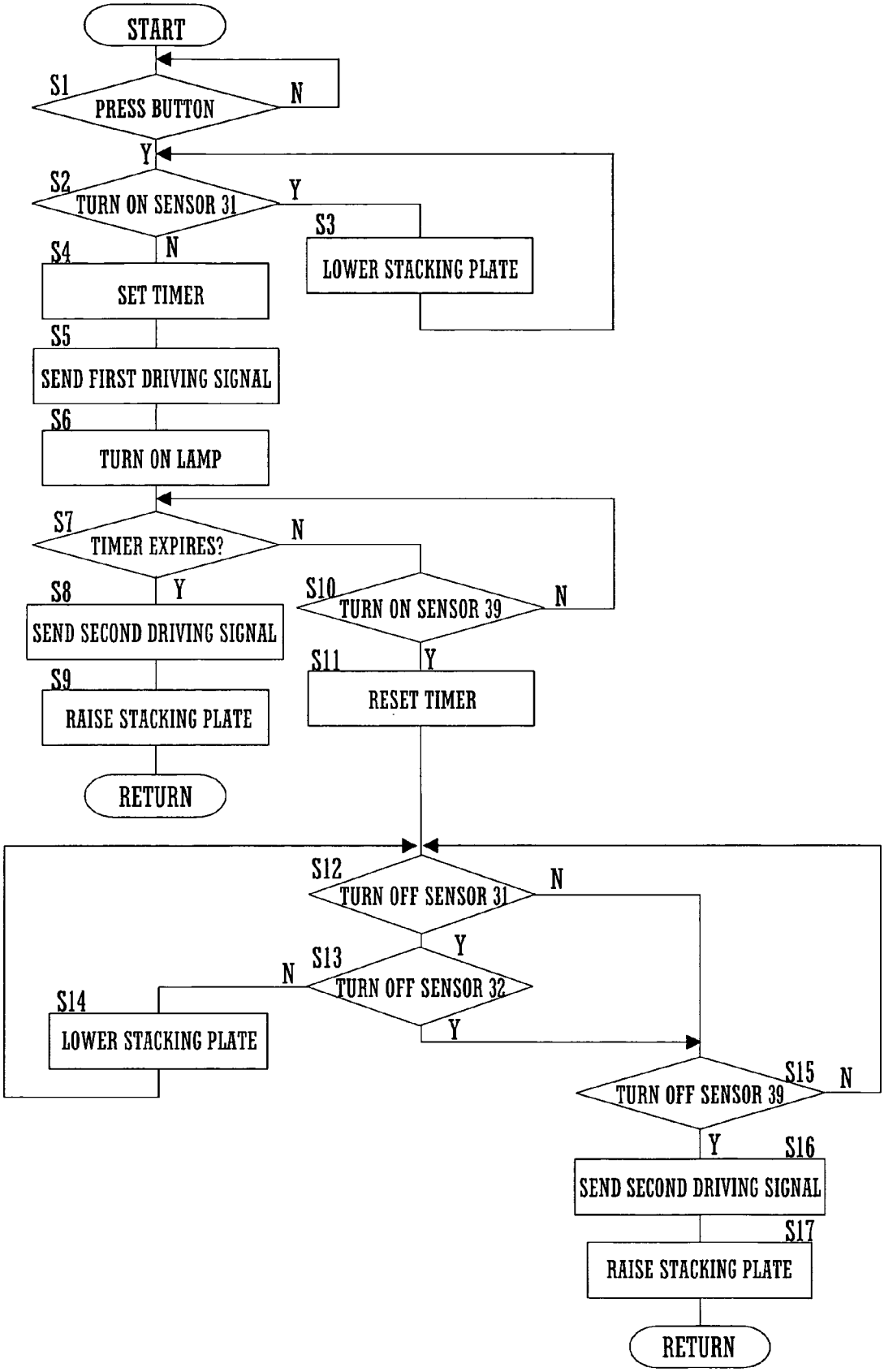
FIG. 8 is a flowchart illustrating part of steps of a process performed by the control section.

FIG. 8 is a flowchart illustrating part of steps of a process performed by the control section 30. The section 30 lowers the plate 21 to a level for being replenished with paper (hereinafter referred to merely as the replenishment level), and renders the stacker 2 movable out of the casing 9, in cases where (i) the button 26 is pressed; (ii) the LCC 1 runs out of paper; and (iii) a paper feeding error occurs. Described below is the case (i): there is a small amount of paper remaining on the plate 21, and the button 26 is pressed in order to replenish the plate 21 with paper in advance of printing in large quantities.

The amount of paper remaining on the plate 21 is indicated, on a 1 to 4 scale for example, on an operation/display section provided in the image forming apparatus 100. At power-on, the section 30 performs an initial operation of lowering the plate 21 to the lowest level within the movable range thereof and then raising the plate 21 to the feeding level. The section 30 detects an approximate amount of remaining paper on the plate 21 by calculating an amount by which the plate 21 is raised from the lowest level, based on the number of rotations of the lifting motor. As the lifting motor, a stepping motor is used for example.

The section 30 raises the plate 21 until the pick-up roller 3 is lifted up to a predetermined level by contact with an upper surface of a top sheet of paper P loaded on the plate 21. At the time, the section 30 determines that the plate 21 reaches the feeding level, and stops raising the plate 21. To detect whether the roller 3 is positioned at the predetermined level, a sensor is provided for detecting an angle of a connecting member that is adapted to connect the roller 3 with the feeding roller 4.

When the button 26 is pressed with the plate 21 loaded with paper (step S1), the section 30 lowers the plate 21 to such a level that a lateral side of stack of paper on the plate 21 is out of the detection range of the sensor 31, i.e., to the replenishment level (steps S2 and S3). Here, the section 30 sets a timer 35 for a predetermined period of time (step S4).

Then, the section 30 sends the first driving signal to the solenoid 54 through the solenoid driver 34, thereby moving the plunger 54A to the unlocking position (step S5). Also, the section 30 causes the lamp 36 to light up to indicate that the lock device 50 is in a releasable state and the stacker 2 is thus in a movable state (step S6).

The section 30 determines whether the predetermined period of time has elapsed since lowering of the plate 21 (step S7). When the timer 35 expires, the section 30 sends the second driving signal to the solenoid 54 through the driver 34, moves the plunger 54A to the locking position (step S8), and raises the plate 21 to the feeding level (step S9).

If the plate 21 is not replenished with paper within the predetermined time period after the button 26 is pressed, thus, the section 30 locks the stacker 2 in the housed position and raises the plate 21 to the feeding level, thereby allowing feeding of the remaining paper P on the plate 21.

When detecting, through the sensor 39, that the handle 27 is operated to move the stacker 2 from the housed position to the exposed position (step S10), the section 30 stops timing the predetermined time period (step S11). At this time, the plate 21 is down at the replenishment level and ready to be replenished with paper by a user.

On replenishment of paper, the section 30 detects, through the sensor 31, a lateral side of paper stack on the plate 21. Then, the section 30 lowers the plate 21 by a predetermined amount to such a level that the lateral side of paper stack is out of the detection range of the sensor 31, i.e., to the replenishment level, while detecting, through the sensor 32, whether the plate 21 reaches the lowest level (steps S12 through S14). Data on the predetermined amount by which the plate 21 is to be lowered is stored in the memory 40 as a lowering condition.

When the plate 21 reaches the replenishment level or the lowest level, the section 30 determines, based on a detection result of the sensor 39, whether the stacker 2 is in the housed position (step S15). When determining that the stacker 2 is not yet in the housed position, the section 30 returns to the step S12. When determining that the stacker 2 is in the housed position, the section 30 moves the plunger 54A to the locking position by sending the second driving signal to the solenoid 54 through the driver 34 (step S16), and then raises the plate 21 to the feeding level (step S17).

When determining in step S13 that the plate 21 reaches the lowest level, the section 30 may detect, through the sensor 33, whether there is any paper on the plate 21. And, when determining that there is paper on the plate 21, the section 30 may generate an alarm by sounding an alarm or lighting up a warning light. This configuration prevents the plate 21 from being loaded with an amount of paper beyond the loading capacity of the LCC 1.

When the last remaining sheet of paper on the plate 21 is fed, the sensor 33 detects a paper-out condition. Then, the section 30 lowers the plate 21 by a predetermined amount to the replenishment level, as in steps S12 through S14.

In the event of paper out or sheet feeding error, the section 30 does not send the second driving signal to the solenoid 54 even after the predetermined period of time has elapsed since the plate 21 is lowered to the replenishment level. This configuration allows the stacker 2 to be held in the movable state and thus ready for replenishment of paper or for fixing of sheet feeding error. Also, this configuration prevents a sheet feeding operation from being performed with the stacker 2 out of paper, thereby avoiding damage to members concerned with sheet feeding (such as the pick-up roller 3). Further, this configuration prevents continuation of a sheet feeding operation after a sheet feeding error occurs, thereby preventing the error from becoming complicated.

The process as described above allows the first driving signal to be output to the solenoid 54 on condition that the plate 21 is positioned below the replenishment level and that an upper surface of a top sheet of paper loaded on the plate 21 is positioned well below the feeding level. In other words, the process allows the stacker 2 to be moved out of the casing 9 by operation of the handle 27 only in a condition where the plate 21, and paper P loaded on the plate 21, are prevented from having contact with sheet feeding members such as the pick-up roller 3, the feeding roller 4, the reversing roller 5, or the transporting rollers 6.

Also, the process as described above allows the second driving signal to be output to the solenoid 54 on condition that the stacker 2 is in the housed position. In other words, the process allows the stacker 2 to be held in the housed position, irrespective of whether the handle 27 is operated or not, in a condition where there is a possibility that the plate 21, and paper P loaded on the plate 21, may have contact with the sheet feeding members.

Accordingly, this configuration prevents failure in, and damage to, the paper feeding members due to contact of the plate 21, and paper P loaded on the plate 21, with the sheet feeding members.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A sheet feeding device comprising:

a sheet stacker having a liftable stacking plate for loading a plurality of sheets; and a casing in which the sheet stacker is detachably housed frontward of the sheet stacker, the sheet stacker including:

a handle supported pivotably between an operational position and a nonoperational position, with the handle exposed outside from frontward of the sheet stacker;

a lock claw supported pivotably between an engaged position to be engaged with an engagement portion and a disengaged position to be disengaged from the engagement portion; and a transmission mechanism for selectively transmitting pivot movement of the handle to the lock claw, the transmission mechanism having:

a solenoid provided with a plunger, the solenoid moving the plunger between a locking position and an unlocking position according to an input driving signal; and an interlock member which moves from a nonoperational position to an operational position along with movement of the plunger from the locking position to the unlocking position, and which transmits to the lock claw pivot movement of the handle from the nonoperational position to the operational position, as movement from the engaged position to the disengaged position, only when the plunger is in the unlocking position, wherein the solenoid moves the plunger from the locking position to the unlocking position when a first driving signal is input, moves the plunger from the unlocking position to the locking position when a second driving signal is input, and maintains the plunger in a current one of the locking and unlocking positions when neither the first driving signal nor the second driving signal is input, and the sheet feeding device further comprising a control section, wherein the control section sends the first driving signal to the solenoid when instructed to enable the sheet stacker to be moved out of the casing, and the second driving signal to the solenoid when the sheet on the liftable stacking plate is feedable.

2. The sheet feeding device according to claim 1, wherein the interlock member includes:

a first arm linked with the handle, the first arm having a contact portion, the contact portion being moved downward as the handle is pivoted from the nonoperational position to the operational position;

a second arm linked with the lock claw, the second arm being supported at a lower end on the lock claw so as to be pivotable between a non-working position and a working position according to whether the plunger is in the locking position or the unlocking position, the non-working position being in which the contact portion is not fitted into a depression, the working position being in which the contact portion is fitted into the depression, the second arm having the depression and an engagement portion, the depression being adapted for the contact portion to be selectively fitted into, the engagement portion being adapted for the plunger to be engaged with;

a first return member for urging the handle toward the nonoperational position; and a second return member for urging the lock claw toward the engaged position, wherein the lock claw is moved to the disengaged position by being pivoted downward from the engaged position.

3. The sheet feeding device according to claim 1, wherein the control section is configured to send the first driving signal to the solenoid, after instructed to enable the sheet stacker to be moved out of the casing, when the liftable stacking plate is positioned at a level below a replenishment level where the liftable stacking plate is positioned to be replenished with sheets.

4. The sheet feeding device according to claim 1, wherein a hole is provided in a bottom surface of the casing, the sheet feeding device further comprising:

an operating bar configured to be attached at an upper end to the lock claw, with a lower end facing the hole, the operating bar, when raised upward, pivoting the lock claw from the engaged position to the disengaged position.

* * * * *